US008843020B2

(12) United States Patent
Huck

(10) Patent No.: US 8,843,020 B2
(45) Date of Patent: Sep. 23, 2014

(54) UNIVERSAL PRINT CARTRIDGE MODIFICATION

(75) Inventor: Donald R Huck, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 278 days.

(21) Appl. No.: 13/240,013

(22) Filed: Sep. 22, 2011

(65) Prior Publication Data

US 2013/0077991 A1 Mar. 28, 2013

(51) Int. Cl.
*G03G 15/00* (2006.01)

(52) U.S. Cl.
USPC ..... 399/109

(58) Field of Classification Search
USPC ..... 399/109, 111, 113
See application file for complete search history.

(56) References Cited

U.S. PATENT DOCUMENTS 5,261,326 A * 11/1993 Michlin ..... 101/483
7,054,577 B2 * 5/2006 Rogers et al. ..... 399/109
7,477,864 B2 * 1/2009 Daniels ..... 399/109
7,764,902 B2 * 7/2010 Silva ..... 399/109
2007/0140732 A1 * 6/2007 Jones et al. ..... 399/109
2007/0217814 A1 * 9/2007 Causey et al. ..... 399/109
2008/0008494 A1 * 1/2008 Martin et al. ..... 399/109
2008/0008495 A1 * 1/2008 Martin et al. ..... 399/109

* cited by examiner

*Primary Examiner* — Robert Beatty

(57) ABSTRACT

A method of modifying a printer cartridge is disclosed. The modifications increase the versatility of an existing cartridge by enabling the cartridge to be transformed into a universal cartridge. The OEM print cartridges are restricted to use in a few or only one type of printer due to specialized gear side end plates and contact side end plates. End plates contain features or portions, such as bosses, which restrict the number of models of printer that a cartridge may be fit into. The features or portions may be removed by any combination of cutting, modifying, or replacing the gear side end or the contact side end plates. Removing the portions, removes the restrictions imposed by the end plates and allows the print cartridge to been fit into a greater number of printers. The universal cartridge may be used in the printer for which it is originally designed as well as another printer or printer family, thus increasing the versatility of the cartridge.

16 Claims, 7 Drawing Sheets

UNIVERSAL PRINT CARTRIDGE MODIFICATION

BACKGROUND

Image forming devices use consumable components, such as toner cartridges. To reduce and save cost it is often desirable to remanufacture used parts of an image forming device. It may be desirable to provide an adapter used to facilitate the modification and remanufacture of an image process cartridge such as a printer toner cartridge. A technique to use such an adapter to modify an imaging process cartridge intended is disclosed. The method used enables an image processor cartridge designed to operate in one type of imaging device to be adapted for use in a plurality of imaging devices such as multiple brands of printers.

Print toner cartridges, once spent, are unusable for their original purpose and may be discarded, even though the image process cartridge itself may still have potential life. As a result, techniques have been developed to remanufacture and refurbishing of various types of imaging components such as toner cartridges, ink cartridges, magnetic rollers and the like. The remanufacturing process may entail disassembly of the various structures of the cartridge, replacing toner, cleaning, adjusting or replacing any worn components and reassembling the cartridge.

Currently, many types of imaging cartridges exist that may be used in only one type of imaging device. Such cartridges may only be remanufactured for use in the same type of imaging device. This constitutes an inefficient allocation of resources because a used cartridge may not be used in any other print device. The differences between printer cartridges for various types of printing devices may only be a slight indentation or protuberance in the body of the imaging cartridge. Such an indentation or protuberance may be incorporated by printer manufacturers in order to restrict a print cartridge from being interchangeable with other imaging cartridges produced by competing manufacturers. Minor modifications to the restricted imaging cartridge may adapt the cartridge for use in other types of printers. What is currently needed in the art is a means by which a restrictive indentation or protuberance may be removed in order to enable the image processing cartridges to be adapted for reuse in other different image processing devices and a method by which such components may be used to remanufacture an imaging cartridge.

SUMMARY

The present application presents a plurality of apparatus configurations and methods which enable an imaging cartridge previously configured for use in one specific printer to be modified into a configuration such that the converted cartridge may be used in a variety of different printers. The modified cartridge may also be used in the cartridge for which it was originally designed. The modified cartridge may now be used in multiple printers, which offers the benefit of reducing the number of imaging cartridge configurations a reseller must store in inventory. The modified cartridge offers the further benefit of allowing remanufactured cartridges from an existing printer to be used in a new printer for which replacement cartridges are not yet readily available.

In one aspect of the present application, a rectangular tab feature is cut off from the contact side end plate. Also, the boss and slide area are cut off from the gear side end plate.

In another aspect of the present application, a rectangular tab feature is cut off from the slide area of the contact side end plate. Also, the entire gear side end plate is removed and replaced with a specially molded endplate that does not contain a boss or a slide.

In another aspect of the present application, the entire contact side end plate is removed and replaced with a specially molded end plate. Also, the gear side end plate is removed and is replaced with specially molded end plates. Cutting is not used to remove tab features.

In another aspect of the present application, the entire contact side end plate is removed and replaced with a specially molded end plate. Also, the boss and slide area are cut off from the gear side end plate.

These and other features and objects of the invention will be more fully understood from the following detailed description of the embodiments, which should be read in light of the accompanying drawings.

In this regard, before explaining at least one embodiment of the invention in detail, it is to be understood that the invention is not limited in its application to the details of construction and to the arrangements of the components set forth in the description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be used as a basis for designing other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The accompanying drawings, which are incorporated in and form a part of the specification, illustrate embodiments of the present invention and, together with the description, serve to explain the principles of the invention.

DETAILED DESCRIPTION OF THE DRAWINGS

The following detailed description of preferred embodiments refers to the accompanying drawings which illustrate specific embodiments of the application. In the discussion that follows, specific techniques for converting an imaging process cartridge, such as a toner printer cartridge, for installation into one or more different types of printers are disclosed. Other embodiments having different structures and operations for the conversion of other types of cartridges for use with other types of printers do not depart from the scope of the present application.

Figure 1:
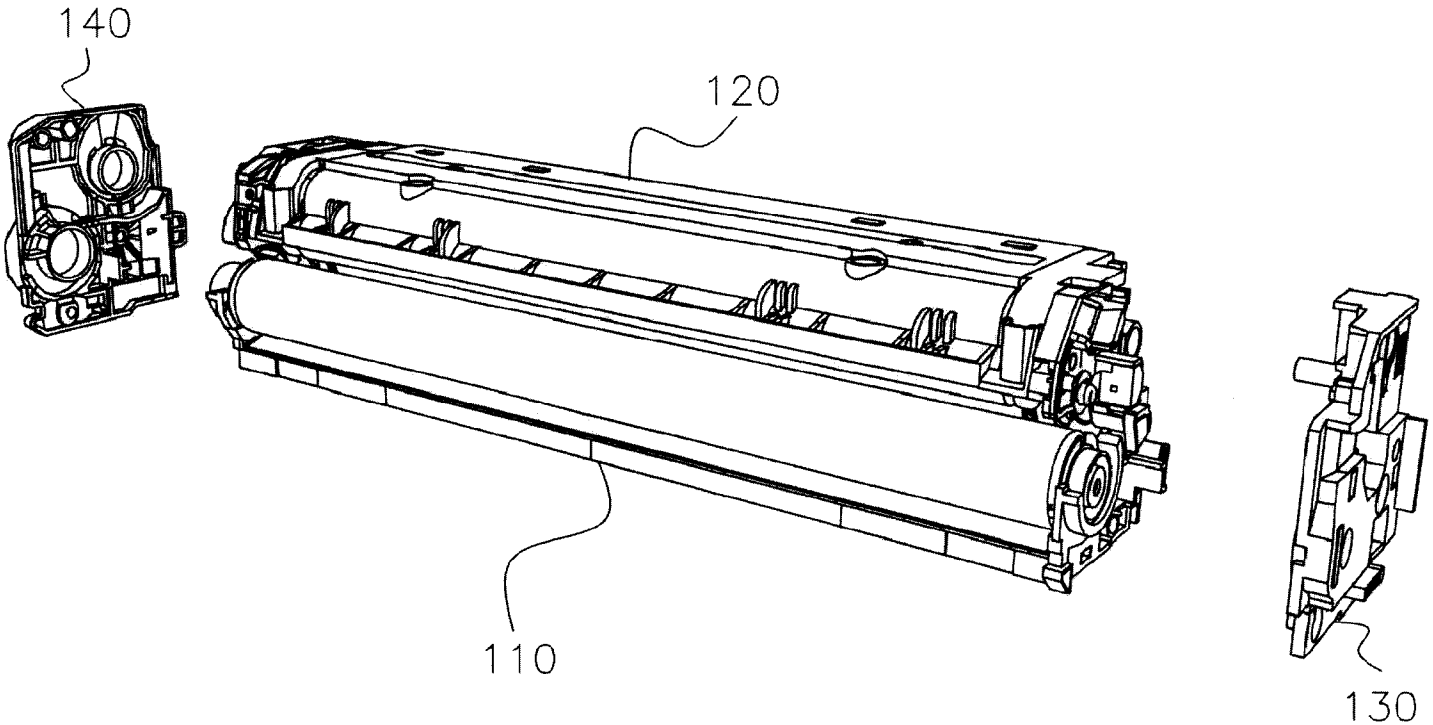
FIG. 1 (Prior Art)
FIG. 1 illustrates a toner cartridge, a contact side, and a gear side.

FIG. 1 illustrates an imaging cartridge 100. A toner hopper section 120 stores toner for use in printing. A waste bin section 110 stores the waste toner that was not used and did not fuse onto the media during the printing operation. This waste toner must be cleaned off the other operational components. The hopper section and waste bin section are spring-loaded to provide movement and are held together by two separate end plates 130, 140 located on opposite sides of the cartridge. On one side of the imaging cartridge is a contact end plate 130, which sets against the side of a printer device. On the opposite side of the imaging cartridge is the gear side end plate 140, which contains the gear side end plate as the side which connects with the gears in a printer and interfaces with the drive mechanism in a printer.

Figure 2:
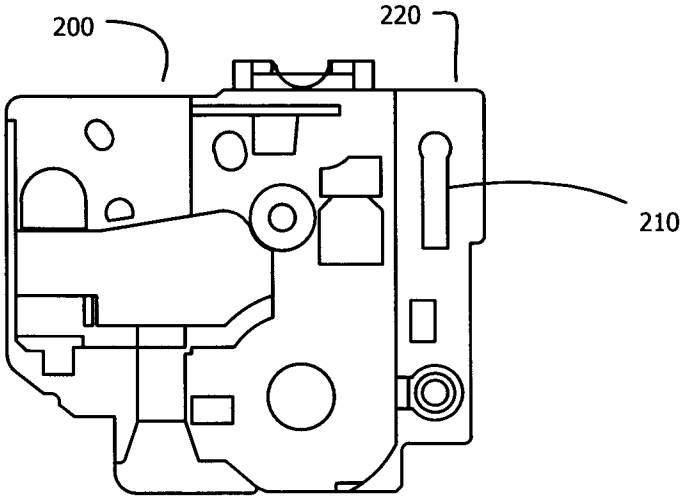
FIG. 2 (PRIOR ART)
FIG. 2 illustrates a contact side end plate from a CE320A-CE323A cartridge used in a CM1415, CP1525 MFP printer family.

FIG. 2 illustrates an embodiment 200 of the present application in which the contact end plate 130 is the contact side end plate 200 from the OEM CE320A-CE323A cartridges which may be used in HP CP1525/CM1415 MFP printers. The modification of the toner cartridge is performed by removing a rectangular tab feature 210, also known as a boss, from the slide area 220 of the contact end plate 200.

Figure 3:
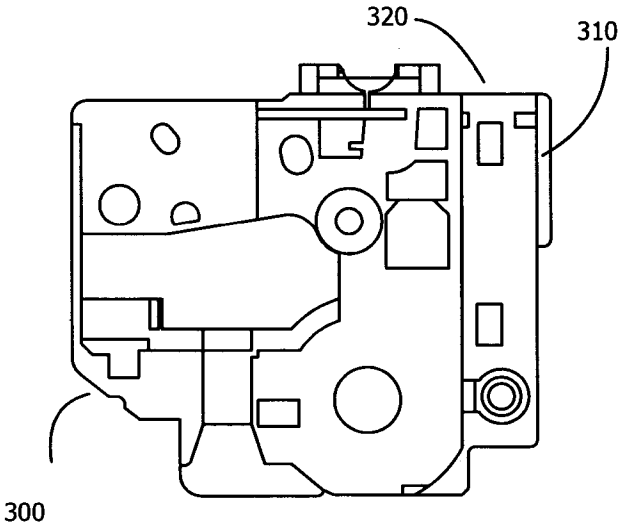
FIG. 3 (PRIOR ART)
FIG. 3 illustrates a contact side end plate from a CB540A-CB543A cartridge used in an HP CP1515/CM1415 MFP printer.

FIG. 3 illustrates the contact end plate 130 after modification is performed 300. The contact side end plate 300 is from the OEM CB540A-CB543A printer cartridges which may be used in the HP CP1515 family of printers. The modification is performed by removing a rectangular tab feature 310, or boss, from the slide area 320 of the contact end plate 300.

Figure 4:
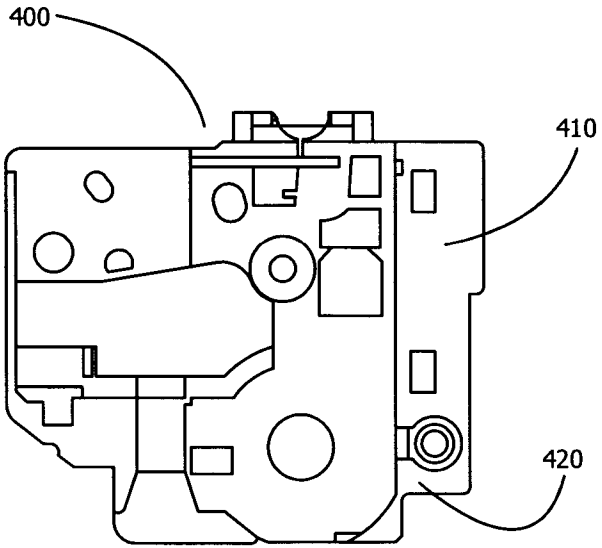
FIG. 4 illustrates a contact side end plate after removal of a rectangular tab feature.

FIG. 4 illustrates the contact side end plate 130 after modification performed 400. Now an empty area exists 410 where the boss used to be subsequent to removal by the method here described. The contact plate resembles the contact side end plate of an OEM HP CB540A. With the boss now removed 410 from the slide area 420 of the modified contact plate 400 of the OEM HP CB540A now resembles the contact plate of the OEM CE320A-CE323A. With the additional modification of the gear side end plate, the OEM HP CB540A cartridge can be used in the same printer devices that now require the OEM CE320A-CE323A cartridge.

Figure 5:
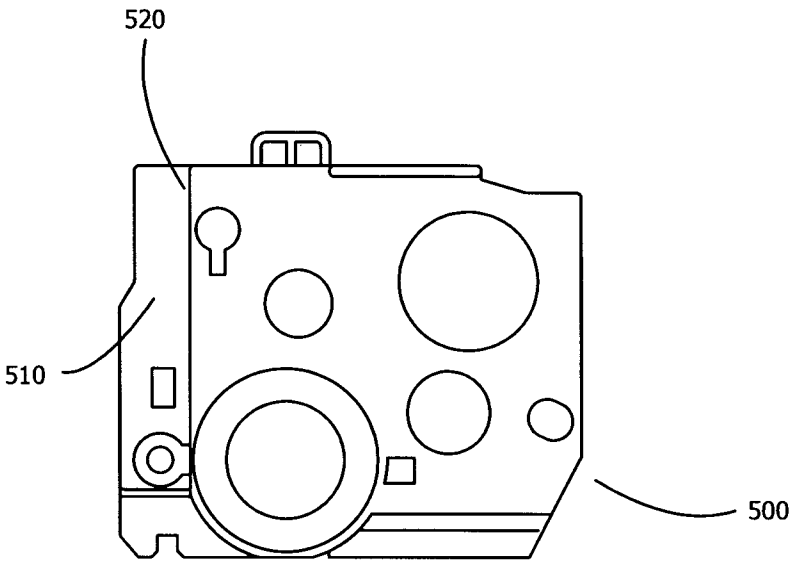
FIG. 5 (PRIOR ART)
FIG. 5 illustrates an unmodified gear side of a CE320A cartridge used in an HP CM1415/CP1525 MFP printer.

FIG. 5 illustrates a second embodiment in which the gear side end plate 140 is modified by cutting a portion off of the of the gear side end plate 500. In this particular instance, the OEM HP CE320A gear side end plate 500. This OEM end plate 500 is presented before any change is performed. The OEM end plate 500 has a flat area 510 has a portion 520 where other end plates would have a slide area.

Figure 6:
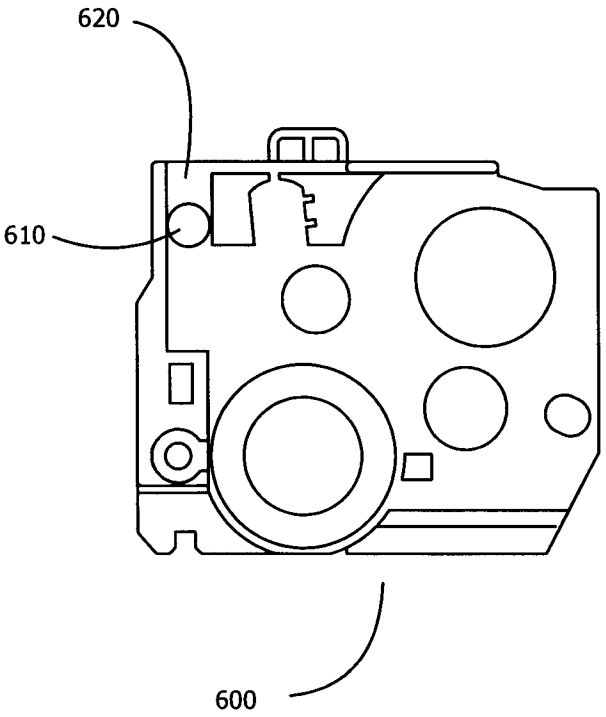
FIG. 6 (PRIOR ART)
FIG. 6 illustrates an unmodified gear side of a CB540A cartridge used in an HP CP1215/CP1515 printer.

FIG. 6 illustrates the gear side end plate 140, with this version being a gear side end plate of the OEM HP CB540A cartridge 600 prior to the removal of the boss 610 and prior to removal of the slide area 620.

Figure 7:
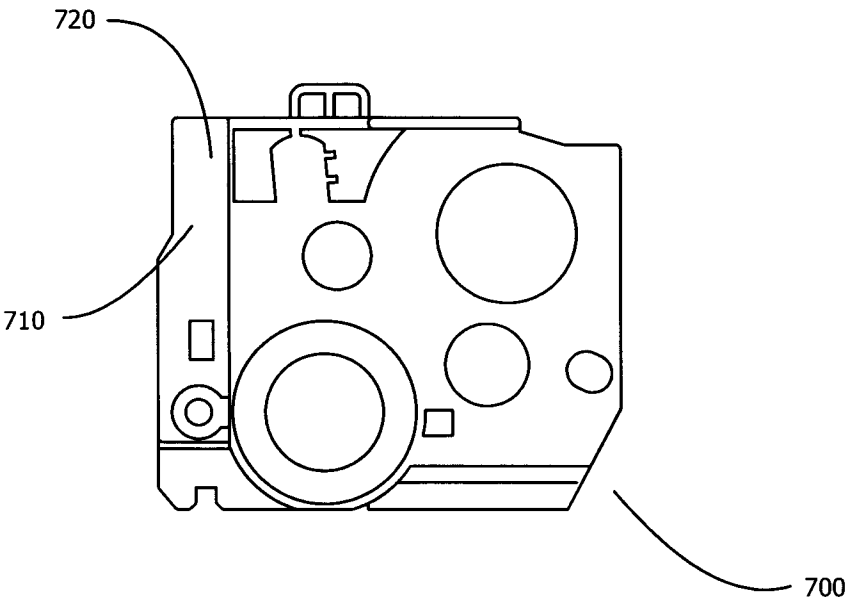
FIG. 7 illustrates a modification of the gear side end plate after removal of the boss and slide area.

FIG. 7 illustrates the gear side end plate 140, with this version being a gear side end plate of the OEM HP CB540A cartridge 700 after the removal of the boss 610. Now an empty area exists 710 where the boss used to be subsequent to removal by the method here described. The slide area 720 is also presented. This modified end plate now resembles the universal end plate.

In a third embodiment, a specially molded gear side end plated is used. The rectangular tab feature, or boss, is not physically removed from the gear side. Now the entire OEM gear side end plate is removed and replaced with a specially molded gear side end plate. The specially molded gear side end plate does not contain the boss and the slide area that were prevalent on the removed gear side end place. The replacement molded gear side end plate is thus molded to resemble the modified gear side end plate without the boss similar to the gear side end plate of the previous embodiment. Thus removal of boss or features from the gear side is not performed because the molded replacement gear side end plate has been molded to the desired replacement gear side end plate from which the boss was removed in the previous embodiment. It may still be necessary to physically modify the contact side end plate by removing a portion manually from the contact side end plate which is opposite to the gear side end plate.

The method of removing the gear side end plate and replacing it with a molded gear side end plate comprises several steps. First the currently attached gear side end plate is located. Next, any fastening device or impediment to the removal of the OEM gear side end plate is removed and set aside. Next the OEM gear side end plate is removed from the cartridge body. Then the specially molded replacement gear side end plate is aligned and located into the vacant position on the side the cartridge. Finally the previously set aside fastening devices are replaced to securely affix the new replacement gear side end plate onto the cartridge.

In a fourth embodiment, a specially molded contact side end plate is used. Here, the rectangular tab feature, or boss, is removed from the gear side end plate as in the previous embodiment. In the present embodiment, the OEM contact side end plate is removed and then replaced with a specially molded contact side end plate. The specially molded contact side end plate does not contain the boss that was prevalent on the removed contact side end place. The replacement molded contact side end plate is thus molded to resemble the modified with the boss removed contact side end plate of the previous embodiment. Thus removal of boss or features is not performed on the contact side because the molded replacement contact side end plate has been molded to the desired replacement contact side end plate from which the boss was removed in the previous embodiment. It may still be necessary to physically modify the gear side end plate by removing a part from the gear side end plate.

The method of removing the OEM contact side end plate and replacing it with a molded contact side end plate is comprised of several steps. First the currently attached contact side end plate is located. Then, any fastening device or impediment to the removal of the OEM contact side end plate is removed and set aside. Next the OEM contact side end plate is removed from the cartridge body. Then the specially molded replacement contact side end plate is aligned and located into the vacant position on the side the cartridge. Finally the previously set aside fastening devices are replaced to securely affix the new replacement contact side end plate onto the cartridge.

In a fifth embodiment similar to a combination of the features in the first, second and third embodiments. The universal cartridge can be created by replacing the OEM contact side with a specially molded contact side end plate and replacing the gear side end plates with new, specially molded gear side end plates. This solution would not require any existing end plate to be cut or modified because both the contact side end plate and the gear side end plate would be removed and disposed of, to be replaced by specially molded contact side and gear side end plate.

In a sixth embodiment, any combination of modification by physical removing the boss, the slide area, or any other portion of either the contact side end plate or of the gear side end plate may be combined with the molded replacement contact side end plate or the gear side end plate. The contact side end plate could be modified by removing a portion, while the gear side end plate could be replaced with the molded replacement. The contact side end plate could be replaced with the molded replacement while the gear side end plate could be modified by removing a portion such as a boss.

The modification of the gear side could be performed first prior to the modification of the contact side. Alternately, the contact side could be modified first prior to the modification of the gear side. Alternately, both the gear side and the contact side could be modified simultaneously. The removing of a portion from the gear side end plate or a portion from the contact side end plate could be performed by any one of, but not limited to: cutting, sawing, snipping, grinding, sanding, pounding, hammering, chiseling, burning, vaporizing, melting, smelting, acid bathing, or sonically reducing.

The cartridge modification embodiments can be complex requiring significant modifications to the cartridge sections in the form cuts, replacement components, or covers. Alternately, the modification may be relatively simple to achieve the conversion and/or universal capabilities. The embodiments herein feature the OEM HP CB540A to CB543A cartridges used in the HP CP1515 family of printers and by making certain modifications to the cartridge, produce a cartridge that will emulate the HP CE320A to CE323A cartridges and fit and function in the HP CP1525 & HP CM1415 MFP printers as well as the HP CP1515 family of printers. The present embodiment concerns the HP CP1515 as a "legacy printer" or "legacy cartridge" while the HP CP1525/CM1415 MFP may be the "new printer" or "new cartridge." It is understood that the methods and examples cited in this document shall not be restricted to the specific cartridges, printers, methods, etc. stated but can be expanded for use in other printers, cartridges, or similar related conversion/universal methods.

The embodiments describe making a cartridge that is designed for a legacy printer to work in a new printer. The described methods may also be used to enable a cartridge designed to be used in one printer family to also be used in another printer family. The described methods may also be used to allow a cartridge designed to be used in one brand of printer to also be used in a different brand printer.

The embodiments describe modifying a used cartridge to allow the cartridge to fit into more than one type of printer. Alternatively, a new toner cartridge having the features of the modified toner cartridge may be provided. This allows for a universal toner cartridge to be made when there is no source of used toner cartridges.

The many features and advantages of the invention are apparent from the detailed specification. Thus, the appended claims are intended to cover all such features and advantages of the invention which fall within the true spirits and scope of the invention. Further, since numerous modifications and variations will readily occur to those skilled in the art, it is not desired to limit the invention to the exact construction and operation illustrated and described. Accordingly, all appropriate modifications and equivalents may be included within the scope of the invention.

Although this invention has been illustrated by reference to specific embodiments, it will be apparent to those skilled in the art that various changes and modifications may be made which clearly fall within the scope of the invention. The invention is intended to be protected broadly within the spirit and scope of the appended claims.

What is claimed is:

1. A method of modifying an imaging process cartridge, the imaging process cartridge designed to fit in a first type of imaging device, the method comprising:

providing the imaging process cartridge having a cartridge body and a contact side end plate attached to the cartridge body, the contact side end plate having an element extending outward from the contact side end plate; and removing at least one portion from the contact side end plate, wherein removal of the at least one portion enables the imaging process cartridge to fit a second type of imaging device, wherein the modified contact side end plate emulates a Hewlett Packard CE320A to CE323A cartridge used in the Hewlett Packard CP1525 printers and the Hewlett Packard CM1415 MFP printers.

2. The method of claim 1 wherein the removing at least portion removes the element extending outward from the contact side end plate projection.

3. The method of claim 1 wherein the element extending outward from the contact side end plate is a boss.

4. The method of claim 1 wherein the first type of imaging device belongs to one family of printers and the second type and imaging device belongs to a second family of printers.

5. The method of claim 1 wherein the imaging process cartridge fits in the first type of imaging device and the second type of imaging device.

6. A method of modifying an imaging process cartridge, the imaging process cartridge sized to be installed in a first type of imaging device and not sized to be installed in a second type of imaging device, the method comprising:

providing the imaging process cartridge comprising a cartridge body and a gear side end plate attached to the cartridge body; and removing at least one portion from the gear side end plate, wherein removal of the at least one portion enables the imaging process cartridge to fit in the second type of imaging device, wherein the modified gear side end plate emulates the Hewlett Packard CE320A to CE323A cartridge used in the Hewlett Packard CP1525 printers and the Hewlett Packard CM1415 MFP printers.

7. The method of claim 6 wherein the at least one removed portion is a boss.

8. The method of claim 6 wherein at least one removed portion comprises a slide area.

9. A method of modifying an imaging process cartridge, the imaging process cartridge sized to be installed in a first type of imaging device and not sized to be installed in a second type of imaging device, the method comprising:

providing the imaging process cartridge having a cartridge body and a gear side end plate attached to the cartridge body;

removing the gear side end plate; and attaching a replacement gear side end plate onto the cartridge body in the position from which the gear side end plate was removed, wherein attachment of the replacement gear side end plate enables the imaging process cartridge to be installed in the second type of imaging device, wherein the removed gear side end plate is one of a Hewlett Packard model CB540A to a Hewlett Packard model CB 543A cartridge used in a Hewlett Packard model CP1515 printer.

10. The method of claim 9 further comprising:

removing fastening elements prior to removing the gear side end plate and inserting the removed fastening elements after attaching the replacement gear side end plate.

11. The method of claim 9 wherein the imaging process cartridge fits in the first type of imaging device and the second type of imaging device.

12. A method of modifying an imaging process cartridge, the imaging process cartridge sized to be installed in a first type of imaging device and not sized to be installed in a second type of imaging device, the method comprising:

modifying a gear side end plate of the imaging process cartridge; and modifying a contact side end plate of the imaging process cartridge, wherein the modified gear side end plate and the modified contact side end plate enables the imaging process cartridge to be installed in the second type of imaging device, wherein the modified gear side end plate emulates the Hewlett Packard CE320A to CE323A cartridge used in the Hewlett Packard CP 1525 printers and the Hewlett Packard CM 1415 MFP printers.

13. The method of claim 12 wherein the gear side end plate is modified by replacing the gear side end plate with a different gear side plate.

14. The method of claim 12 wherein the gear side end plate is modified by removing a portion of the gear side end plate.

15. The method of claim 12 wherein the contact side end plate is modified by replacing the contact side end plate with a different contact side end plate.

16. The method of claim 12 wherein the contact side end plate is modified by removing a portion of the gear side end plate.

* * * * *